US005768912A

United States Patent [19]

Dubar

[11] Patent Number: 5,768,912

[45] Date of Patent: Jun. 23, 1998

[54] LIQUEFACTION PROCESS

[76] Inventor: Christopher Alfred Dubar, 410 Balcombe Road, Beaumaris, VIC 3193, Australia

[21] Appl. No.: 716,322

[22] PCT Filed: Apr. 5, 1995

[86] PCT No.: PCT/AU95/00191

§ 371 Date: Jan. 21, 1997

§ 102(e) Date: Jan. 21, 1997

[87] PCT Pub. No.: WO95/27179

PCT Pub. Date: Oct. 12, 1995

[30] Foreign Application Priority Data

Apr. 5, 1994 [AU] Australia ..... PM4856

[51] Int. Cl.[6] ..... F25J 3/00

[52] U.S. Cl. ..... 62/613; 62/912

[58] Field of Search ..... 62/612, 613, 614, 62/912

[56] References Cited

U.S. PATENT DOCUMENTS

| | | | |
|---|---|---|---|
| 3,194,025 | 7/1965 | Grossmann | 62/614 |
| 3,818,714 | 6/1974 | Etzbach et al. | 62/612 |
| 4,094,655 | 6/1978 | Krieger | 62/612 |
| 4,608,067 | 8/1986 | Marshall | 62/613 |
| 4,638,639 | 1/1987 | Marshall et al. | 62/613 |
| 4,758,257 | 7/1988 | Gates et al. | 62/613 |

FOREIGN PATENT DOCUMENTS

| | | | |
|---|---|---|---|
| 1208196 | 10/1970 | United Kingdom | 62/612 |
| 1454803 | 11/1976 | United Kingdom | 62/612 |

*Primary Examiner*—Christopher Kilner

*Attorney, Agent, or Firm*—Kerkam, Stowell, Kondracki & Clarke P.C.; Edward J. Kondracki

[57] ABSTRACT

A process for producing a liquefied natural product such as LNG is described where a single phase nitrogen refrigerant is used in such a way that the refrigerant stream (10) is divided into at least two separate portions (12, 14) which are passed through separate turbo-expanders (106, 108) before being admitted to separate heat exchangers (103, 104) so that the warming curve of the refrigerant more closely matches the cooling curve of the product being liquefied so as to minimize thermodynamic inefficiencies and hence power requirements involved in operation of the method.

29 Claims, 6 Drawing Sheets

LIQUEFACTION PROCESS

BACKGROUND OF THE INVENTION

The present invention relates generally to liquefaction processes and in particular to liquefaction of gaseous products including natural gas. The invention particularly relates to the initial liquefaction of natural gas from the field. More particularly the present invention relates to a method and process for operating a liquefaction plant in a more efficient and economical manner. Even more particularly, the present invention relates to the use of nitrogen as the refrigerant in the liquefaction of natural gas, more particularly, to a modification of or an improvement in the nitrogen expander cycle process which is used in the liquefaction of natural gas feed stock whereby the supply of nitrogen that is used to effect cooling of the natural gas feed is divided into two or more portions in which each portion effects cooling of the natural gas in a different operation and/or in different parts of the installation in which the overall process is conducted and at different temperatures and pressures. The present invention particularly relates to split nitrogen flow cycles whereby the different portions of the nitrogen refrigerant are passed through different expanders which are arranged in parallel with each other.

DESCRIPTION OF RELATED ART

Although the present invention will be described with particular reference to process cycles for the liquefaction of natural gas in which nitrogen is used as the refrigerant, it is to be noted that the scope of the present invention is not restricted to the described embodiment or embodiments but rather the scope of the present invention is more extensive so as to include other methods and applications of the process using nitrogen, and to the use of other gases in the improved application or in other applications than those specifically described.

Natural gas which is obtained in the form of a gas from gas and oil fields occurring in nature, is discharged from the earth to form a natural gas teed which requires processing before it can be used commercially. The natural gas feed enters a processing facility and is processed through a variety of operations in different installations to finally emerge as liquid natural gas (LNG) in a form which is suitable for use. The liquid gas is subsequently stored and transported to another suitable site for revaporisation and subsequent use. In the processing of the natural gas feed the gas emerging from the naturally occurring field must be first pretreated to remove or reduce the concentrations of impurities or contaminants, such as for example carbon dioxide and water or the like, before it is cooled to form LNG in order to reduce or eliminate the chances of blockage to equipment used in the processing occurring and to overcome other processing difficulties. One example of the impurities and/or contaminants are acid gases such as carbon dioxide and hydrogen sulphide. After the acid gas is removed in an acid gas removal installation, the feed gas stream is dried to remove all traces of water. Mercury is also removed from the natural feed gas prior to cooling. Once all of the contaminants or unwanted or undesirable materials are removed from the feed gas stream it undergoes subsequent processing, such as cooling, to produce LNG.

Cooling of the natural gas feed may be accomplished by a number of different cooling process cycles, such as for example, the cascade cycle where refrigeration is provided by three different refrigerant cycles, i.e. by using methane, ethylene and propane in sequence. Another cooling process cycle uses a propane precooled, mixed refrigerant cycle which involves the use of a multicomponent mixture of hydrocarbons, e.g. propane/ethane/methane and/or nitrogen in one cycle and a separate propane refrigeration cycle in another cycle to provide precooling of the mixed refrigerant and natural gas. A further cooling process involves the use of a nitrogen expander cycle in which, in its simplest form, a closed loop is employed in which nitrogen gas is first compressed and cooled to ambient conditions with air or water cooling and then further cooled by counter-current exchange with cold low pressure nitrogen gas. The cooled nitrogen stream is then expanded through a turbo-expander to produce a cold low pressure stream. The cold nitrogen gas is used to cool the natural gas feed and the high pressure nitrogen stream. The work produced in the expander by the nitrogen expanding is recovered in a nitrogen booster compressor connected to the shaft of the expander. Thus, in this process cold nitrogen is not only used to liquefy the natural gas by cooling it but the cold nitrogen is also used to precool or cool nitrogen gas in the same exchanger. The precooled or cooled nitrogen is then subsequently further cooled by expansion to form the cold nitrogen refrigerant.

Improvements to the simple nitrogen cycle have been disclosed whereby the high pressure nitrogen refrigerant is divided into two portions where one portion is isentropically expanded in a turbo-expander and a second portion is isenthalpically expanded through a valve to produce, in some applications, liquid refrigerant. The objective of this improvement is to avoid large separations between the heating and cooling curves which are evidence of thermodynamic inefficiencies and higher power requirements for the refrigeration loop. The field of application for this type of modification has typically been for reliquefying low temperature, low pressure boil-off gases from LNG storage vessels which may contain high nitrogen content in the gas during transportation of the LNG or during offloading operations or when the vessel is in restricted areas where venting of LNG is prohibited, such as in major population centres and the like. However, the operating parameters for reliquefying boil-off gases are completely different to the operating parameters for producing LNG from field gases.

One such different operating parameter is that the cooling curves for boil-off gases are a different shape to that encountered for the liquefaction of natural gas in base-load plants or peak-shaving plants where the natural gas feed is usually available at high pressure and ambient temperature resulting in a different shape of cooling curve. The known modifications to the nitrogen cycle to essentially reliquefy boil-off gas from LNG that has previously been made elsewhere do not result in the same reductions in power requirements that the present invention provides, firstly due to the better matching of the cooling curve for the high pressure, ambient temperature feed stream and secondly as a result of expanding the second portion of the refrigerant isentropically through a turbo expander rather than isenthalpically through a valve which results in higher thermodynamic irreversibilities, and thus consumes more power which is opposite to the present invention which consumes less power.

Other improvements to the simple nitrogen refrigeration cycle are also known from the air separation industry whereby the high pressure nitrogen refrigerant is similarly divided into two portions where one portion is isentropically expanded in two turbo-expanders in sequence with reheating of the refrigerant from the first expander against feed gas before expanding in the second expander. The second portion of the refrigerant is expanded isenthalpically as discussed above through a valve and the objectives as before are to reduce the separations of the heating and cooling curves and hence minimise the power requirements for the refrigeration cycle. When this known modification is applied to the liquefaction of high pressure natural gas at ambient temperature it does not result in the same reductions in power that the present invention would obtain due to the better matching of the cooling curve and reduction in the thermodynamic irreversibilities associated with the expansion of the second portion of refrigerant isenthalpically through a valve.

The present invention is a further modification of or an improvement in the use of the nitrogen expander cycle and involves the use of a single phase refrigerant which is a gas which is wholly nitrogen or a gas which is a major portion of nitrogen mixed with minor amounts of other suitable gases, such as methane, or is any other gas which could be used as a single phase refrigerant when cooled by expansion in a turbo-expander. However, in operation of the present invention, it is usual to use a gas which is substantially wholly nitrogen.

Although the nitrogen expander cycles of the prior art are usually only considered for small scale LNG plants or boil-off gas reliquefaction because the power consumption of using this refrigeration system is generally greater than for other cooling cycles, thus making operating costs for LNG produced by this method more expensive than when using other refrigeration systems, the nitrogen expander cycle has a number of inherent advantages when compared to the conventional mixed refrigeration cycle. These advantages include the use of a safe non-flammable refrigerant as opposed to the use of large amounts of flammable hydrocarbons which are necessary when using the mixed refrigerant process. Another advantage includes the easy replenishment of the nitrogen refrigerant which is readily available and easily obtained since fresh nitrogen refrigerant is readily extracted from the atmosphere at the plant site whereas with the mixed refrigerant processes relatively large amounts of each of the components of the mixed refrigerant cycle must be obtained either from the natural gas feed by being extracted from the natural gas feed, fractionated into the various components and independently stored, and then recombined in the correct proportions to replenish the refrigerant or be brought to the site and stored until needed. When sufficient natural gas liquids are not present in the natural gas feed stream, the different components of the mixed refrigerant must be imported, all of which adds to the cost of using this form of refrigerant and to the overall cost of the process, and hence the final cost of the LNG itself. Additionally, storage facilities are required for each of the components of the mixed refrigerant system which contributes to the size and complexity of the overall installation and results in additional operating costs and safety problems.

A further advantage of using nitrogen as the refrigerant or as the major part of the refrigerant relates to the physical size and layout of the installation in that conventional mixed refrigerant processes require a large number of individual equipment items associated with the propane precooling loop and other ancillary services to the basic mixed refrigerant loop to be located at widely spaced apart locations to allow room for piping and valves and to reduce the risk of fire and to avoid other safety hazards whereas processes using nitrogen do not present the same fire risks or safety hazards as nitrogen is not combustible and also less individual equipment items are required and what items are required can be located much closer together which reduces the physical size and complexity of the overall installation. The reduction in size, complexity, safety hazards and fire risks in the LNG installation using nitrogen refrigerant results in the possibility of nitrogen refrigerants being able to be used in off-shore installations, if it were not for the high power consumption of operating plants using the nitrogen refrigerant cycles. Nitrogen expander cycles have not as yet met with widespread use or acceptance for LNG production from natural gasfields because of the high power consumption of using such refrigerants due to the inherent inefficiencies of using nitrogen as the refrigerant. One inherent inefficiency results from the warming curve of the nitrogen refrigerant not being able to be closely aligned to or matched with the cooling curve of the feed gas being used to produce the LNG. Any divergence between the two curves results in inefficiencies due to waste or excess work being done by the refrigeration cycle. Attempts to match the curve by splitting the nitrogen into two portions after the first nitrogen flow cooling phase and passing one portion through a valve have only resulted in small reductions in power consumption. Furthermore, such nitrogen expander cycles have only been used for small scale liquefaction of natural gas from boil-off after the initial liquefaction, where the liquefaction can be performed at higher temperatures and the gas consists mainly of lighter hydrocarbon portions. Furthermore, in previous nitrogen flow cycles advantage has not been taken of the work of the nitrogen as in the present invention where the work collected in the expander is used in the compressor.

Therefore, if the power consumption disadvantages of using the nitrogen recycle process could be overcome, it would be possible to enjoy the inherent advantages of using these processes and moreover if it were possible to use a nitrogen expander cycle more efficiently it could be possible to produce LNG from field gas more efficiently and at a lower cost which would mean that reserves of natural gas that hitherto before could not be used to produce LNG economically could now be used as the LNG could be made more cheaply. Also it would mean that LNG production facilities could be located off-shore.

SUMMARY OF THE INVENTION

Therefore, it is an aim of the present invention to provide a modified nitrogen expander cycle or other process using nitrogen as a refrigerant which results in the production of LNG more economically and efficiently so as to render the production of LNG to be more viable in existing plants or to be able to commission new plants for making LNG, or to locate LNG plants in places where it has not previously been possible, such as for example off-shore.

However, it is to be noted that the present invention is not limited to the liquefaction of natural gas using a modified nitrogen expander cycle but it can equally apply to the refrigeration of any feedstream in which there are large separations between the cooling and warming curves of the feedstock and refrigerant respectively when the simple nitrogen cycle is used as the refrigerant.

According to the present invention there is provided a method of treating a feed material to produce a commercial product by liquefaction of the feed material using a single phase refrigerant, said method comprising dividing the refrigerant into two or more supply portions, supplying a first portion of the refrigerant to a first heat exchanger for cooling the feed material to an intermediate temperature and supplying a second portion of the refrigerant to a second heat exchanger for cooling the feed material to a further temperature such that the temperature of cooling of the second portion is lower than the temperature of cooling of the first portion whereby the warming curve of the refrigerant of the first and second supply portions comprise at least two discrete portions having different gradients so that the combined warming curve of the refrigerant is more closely matched to the cooling curve of the feed material so as to minimise thermodynamic inefficiencies and hence power requirements involved in operation of the method.

According to another aspect of the present invention there is provided a method of treating a natural gas feed material to produce a commercial LNG product by liquefaction of the feed material using a single phase refrigerant comprising at least mainly nitrogen, said method comprising dividing the refrigerant into at least two portions, supplying each portion of the refrigerant to a different heat exchanger for cooling the feed material over different temperature ranges, such that the temperature of cooling of each portion of refrigerant in the heat exchanger is different, so that the combined warming curve of the refrigerant made up of the warming curves of the various portions of refrigerant exhibit discrete gradients corresponding to the various portions of refrigerant so that the combined warming curve of the refrigerant can be selectively adjusted to closely match the cooling curve of the feed material so as to minimise thermodynamic inefficiencies and hence power requirements in the operation of the method to produce the commercial product by selectively altering the relative portions of each refrigerant portion to each other when dividing the refrigerant into the at least two portions.

Typically, there are two, three, four or more portions of refrigerant. More typically, the proportions are divided from 15% to 85% of the total flow. In the event that the refrigerant is divided into two portions, the ratios are preferably 50% to 80% for the first portion and 50% to 20% for the second portion. More typically, the larger first portion is supplied to the first exchanger such that the temperature of cooling of the second portion is less than the temperature of cooling of the first portion. More typically, the stream of lesser volume is passed to the colder of the exchangers or the coldest exchanger, even more typically to an exchanger which is colder than the exchanger to which the stream of greater volume is passed.

A further modification of the present invention relates to dividing the nitrogen refrigerant stream into three separate streams. In this embodiment which is a further variation on the split nitrogen flow process there are three expanders in parallel with each other with splits of approximately 20/50/30% by volume of the total volume of the nitrogen refrigerant. The coldest level (30%) runs at an outlet pressure of 11.7 bar or similar to other embodiments described, while the warmer levels (50% and 20%) run at a different outlet pressure of 19.4 bar. The high pressure feed to the third (warmest) expander is precooled to 10° C. by a conventional refrigeration or chilled water system, however, the system can be configured to run without it at slightly higher power requirements. In this embodiment where the refrigerant is returned to or forms the main refrigerant stream there are three separate parallel streams, each stream having one of the three expanders in parallel. The three streams are returned to separate exchangers. The warming/cooling curve of this arrangement shows that the two curves are more closely aligned and match with each other in the region from about −100° C. to about 20° C., particularly in the region about −80° C. to about −40° C., in addition to matching of the curves below about −100° C.

Typically, the present invention provides a significant improvement in the simple nitrogen expander cycle process for the liquefaction of gases, particularly natural gas, and more particularly when producing LNG. The improvement in efficiency of the simple nitrogen refrigeration cycle as applied to the liquefaction of natural gas is achieved through modification of the closed loop refrigeration cycle to allow closer alignment or matching of the warming curve of the nitrogen refrigerant with the cooling curve of the natural gas, or of the combination of natural gas and nitrogen refrigerant which is to say the process of the present invention is operated by adapting or changing the warming curve of the nitrogen refrigerant to more closely approximate the cooling curve of the feed gas being processed when the cooling curve of the nitrogen refrigerant used for the precooling step is also taken into account.

More typically, the present invention provides a significant improvement to the simple nitrogen expander cycle process for the liquefaction of gases including natural gas. The method of the present invention comprises dividing the refrigerant into two portions after initial precooling in the first exchanger whereby the first portion is expanded at near to isentropic conditions in a turbo-expander to provide cooling of the natural gas to about −95° C. and also to provide further cooling of the second portion of the refrigerant such that when this second portion is also isentropically expanded in a second turbo-expander it provides final cooling of the natural gas stream to the required temperature of about −140° C. to −160° C. to form LNG suitable for the next stage of processing which is reduction of the nitrogen content of the LNG if required. The division of the refrigerant into two portions at two different temperature levels allows the close matching of the warming curve of the nitrogen refrigerant to the cooling curve of the natural gas feed and cooling curve of the nitrogen refrigerant when being precooled.

Typically, in the operation of the simple nitrogen expander cycle all of the high pressure nitrogen refrigerant is first cooled to an intermediate temperature by the low pressure nitrogen refrigerant at a colder temperature and then the cooled high pressure nitrogen is expanded in a turbo-expander to form a cold low pressure nitrogen stream to further cool the natural gas to the required temperature to form LNG which is from about −140° C. to about −160° C. The intermediate temperature is selected to be low enough such that when the nitrogen is expanded in the turbo-expander the temperature of the cold low pressure nitrogen gas thus produced by the expansion is just sufficiently low enough to subcool the natural gas to the required temperature of about −140° C. to −160° C. At this temperature which exists at the cold end of the heat exchanger the warming curve of the nitrogen is almost coincident with the cooling curve of the feed gas and accordingly there is a close approximation of both curves at this temperature which is the lowest temperature required of the cooling process. Thus, this sets the lowest temperature of the heat exchange process.

The warming curve of the nitrogen refrigerant is essentially a straight line having a slope which is adjusted by varying the circulation rate of nitrogen refrigerant until a close approximation is achieved between the warming curve of the nitrogen refrigerant and the cooling curve of the feed gas at the warm end of the exchanger. This sets the upper limit of operation of the liquefaction process. Thus, by using this method it is possible to obtain relatively close approximations at both the warm and cold ends of the heat exchanger between the different curves. However, because of the different shapes of the respective curves in the intermediate portion of each it is not possible to maintain a close approximation between the two curves over the entire temperature range of the process, i.e. the two curves diverge from each other in their intermediate portions. Although the nitrogen refrigerant warming curve approximates a straight line, the cooling curve of the feed gas and nitrogen is of a complex shape and diverges markedly from the linear warming curve of the nitrogen refrigerant. The divergence between the linear warming curve and the complex cooling curve is a measure of and represents thermodynamic inefficiencies or lost work in operating the overall process. Such inefficiencies or lost work are partly responsible for the higher power consumption of using the nitrogen refrigerant cycle compared to other processes such as the mixed refrigerant cycle. Such a situation is represented by FIG. 1.

Typically, operation of the present invention, hereinafter referred to as the split flow nitrogen expander cycle, results in reduction of the thermodynamic inefficiencies or lost work when using this improved method. Such reductions are achieved by dividing the warming curve for the nitrogen refrigerant into a number of discrete sections each having different slopes so that the warming curve of the nitrogen refrigerant is more closely matched to the cooling curve of the feed gas and nitrogen so that the temperature differences and hence thermodynamic losses between the two are minimised. In one example of the present invention described below and illustrated with reference to FIG. 2, the warming curve is divided into two discrete sections by splitting the supply of compressed and cooled nitrogen used in the process into two parts. The first supply part is expanded in a turbo-expander to a lower pressure at a lower temperature and provides cooling to an intermediate temperature. The second supply part is cooled further and then expanded in a second turbo-expander to a lower pressure at a still lower temperature and provides cooling of the natural gas to the lowest temperature required of the liquefaction process. The flow rate of the second supply part is chosen so that the slope of the warming curve of the nitrogen is approximately the same as that of the cooling curve for subcooling natural gas in the cold end of the heat exchanger. This maintains close temperature approaches or approximation throughout the exchanger. The second supply part of the nitrogen refrigerant is warmed in the heat exchanger to the same temperature as that achieved in the expansion of the first supply part of the nitrogen in the first expander i.e. to the intermediate temperature. In this example the two turbo-expanders are located in parallel arranged streams. In a typical example of the present invention both of the nitrogen supply streams are expanded to the same pressure which allows the streams to be recombined at the intermediate temperature level, hence simplifying the heat exchanger arrangement. The combined streams are now reheated as before in the simple nitrogen expander cycle and the increased mass flow of the combined stream compared to that of the second supply part of refrigerant results in a reduced slope of the warming curve of the refrigerant in the remainder of the heat exchangers. The flow rate of the second supply part of nitrogen is chosen to give a feasible temperature approach at the warm end of the first exchanger. As illustrated by a comparison between FIGS. 1 and 2 the split flow nitrogen expander cycle of FIG. 2 increases significantly the average internal temperature at which the heat exchanger is operated and more closely matches the warming curve of the refrigerant to the cooling curve of the feed gas and nitrogen as compared to the simple cycle, especially at or towards the cold end of the heat exchanger.

Typically, further improvements to the split nitrogen cycle include combining other known enhancements with the simple cycle of the present invention. Such enhancements include adding a separate precooling refrigeration cycle (e.g propane,ammonia absorption or freon) to the nitrogen cycle which increases the efficiency of the simple cycle. The use of two expanders to expand the cooled nitrogen serially in two stages with reheating of the cold gas from the first expander before expanding in the second expander also increases the efficiency of the simple cycle.

BRIEF DESCRIPTION OF THE DRAWINGS

The present invention will now be described by way of example with reference to the accompanying drawings in which.

DESCRIPTION OF THE PREFERRED EMBODIMENTS

EXAMPLE 1

Figure 1:
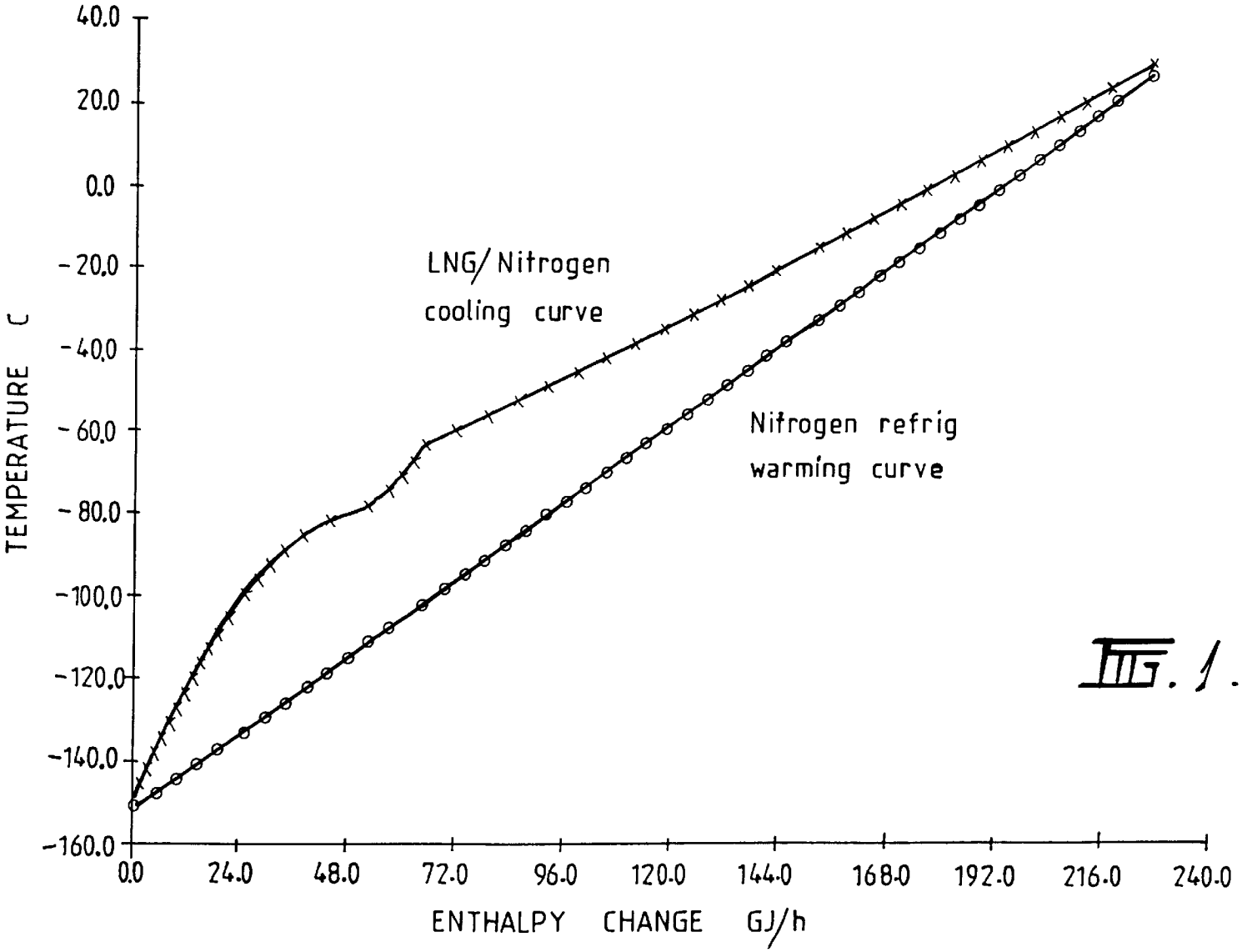
FIG. 1 is a plot of the nitrogen refrigerant warming curve as a comparison of the LNG/nitrogen cooling curve for the simple nitrogen expander cooling cycle in accordance with the prior art showing the divergence of the two curves from each other in their respective intermediate portions, which divergence represents wasted energy.

One embodiment of the present invention will now be described with reference to FIG. 4 which shows one example of the present invention as applied to the liquefaction of a lean natural gas feed stream. Turning first to the cooling of the natural gas feed to produce LNG, it can be seen that a compressed natural gas feed stream at about ambient temperature, denoted by reference numeral 1, comprising predominantly methane, is treated in a conventional pretreatment plant A to remove water, carbon dioxide and mercury contaminants. Various pretreatment arrangements are known and the exact pretreatment necessary depends on the precise composition and the level and nature of undesirable contaminants or impurities present in the natural gas feed. Pretreatments for removing the contaminants and impurities are in accordance with techniques well known to those skilled in the art.

The treated feed, stream 2, emerging from pretreatment plant A is then passed to and cooled in heat exchanger device 100 and then in other heat exchangers 101 to 103 in turn to more or less liquefy the gas feed to produce liquid LNG. The heat exchangers comprise one or more separate heat exchangers and use the main stream of nitrogen refrigerant as the coolant. More specifically, the stream of cooled feed gas 3 emerging from heat exchanger 100 is passed serially through heat exchanger 101 where it is cooled to −84° C. and on emerging from exchanger 101 as stream 4 is passed through heat exchanger 102. The liquefied feed 5 emerging from heat exchanger 102 is then further cooled to approx −149° C. with a smaller stream of nitrogen refrigerant at a temperature of about −152° C. in heat exchanger 103. The subcooled high pressure LNG, stream 7, exiting from heat exchanger 103 then flows directly to storage, after reducing the pressure through a valve or other suitable means, or if necessary, via a conventional nitrogen rejection unit B where nitrogen is removed in the flash gas resulting from the letdown of pressure of the LNG, depending on the level of nitrogen in the feed and/or the LNG specification required for storage and subsequent use or transportation to a remote site for subsequent use. Thus, natural gas feed is introduced in the form of a gas as stream 1 and is discharged as a LNG in the form of a liquid as stream 7.

The nitrogen refrigeration cycle which transforms gas stream 2 to liquid stream 7 will now be described starting with warm nitrogen stream 22 which has been exhausted of all or most of its cooling properties by absorbing heat from the feed gas. The warm nitrogen, stream 22, exhausted of its cooling properties is at the lowest pressure of the cycle of about 10 bar, and is fed to and recompressed in a multistage compressor unit 105 provided with intercooling and aftercooling stages to produce compressed stream 23 at about ambient temperature. Operation of compressor unit 105 consumes almost all of the power required by the nitrogen expander cycle. Stream 23 is divided into 2 streams 24 and 25 which are fed to compressors 108,109 respectively so that each stream is boosted in pressure from about 30 bar to about 55 bar by compressors 108 and 109 to form streams 26 and 27 respectively. Compressors 108,109 are attached to expanders 106 and 107 respectively and recover the majority of the work produced by the expanders 106,107 (to be described in detail below). Alternatively, compressors 108 and 109 can be replaced with a single compressor driven by both expanders 106 and 107, such as for example being connected to a common shaft. The compressed nitrogen streams 26,27 are combined into a single stream 28 which is then cooled in aftercooler 110 to ambient conditions to produce stream 29 which flows to exchanger 100 as stream 10. In exchanger 101, stream 10 is precooled to −20° C. by the countercurrent passage of nitrogen refrigerant stream 21 through exchanger 100 to form stream 22 which is now exhausted of its cooling properties. Stream 10 emerges as stream 11 from exchanger 100.

The close approach or approximation of the refrigerant warming curve to the feed cooling curve made possible by operating the system in accordance with the present invention is achieved in this example by splitting the compressed nitrogen refrigerant stream 11 which exits from heat exchanger 100 into two main portions, stream 13 and stream 12. One portion which is stream 13 comprising approx 35% of the main flow of nitrogen refrigerant from stream 11 is precooled in heat exchanger 101 to form stream 14 a temperature of approximately −84° C. by the counter flow of nitrogen refrigerant from stream 20 to stream 21. Stream 14 exiting from heat exchanger 101 is then combined with a small stream of nitrogen, stream 31, which was split off from stream 29 as stream 30 when stream 10 was formed. Stream 30 had been previously precooled to approx −120° C. in heat exchanger device 104 using cold natural gas/nitrogen reject stream 8, produced by the nitrogen rejection unit B through which stream 6 was passed in installations where this unit is provided. The combined cold stream, stream 15, formed from streams 31 and 14 is then expanded at close to isentropic conditions in expander 107 at a pressure of approx 11 bar to form a very cold stream 16 of nitrogen refrigerant. The resulting cold stream, 16 which is at a temperature of approx −152° C. is used to subcool the high pressure LNG in exchanger 103. The flow rate of stream 16 is chosen to provide a close approach of the refrigerant warming curve to the LNG cooling curve in the regions below about −100° C. in accordance with the present invention. Stream 16 emerges from heat exchanger 103 as stream 17 which is combined with stream 18 from expander 106 to form stream 19 which is used to provide cooling of the natural gas feed stream 5 in heat exchanger 102 as described previously. The combination of stream 18 with stream 17 will be described in more detail later.

The modification of the present invention over the conventional nitrogen expander cycle and other previous modifications of this cycle resides mainly with stream 12 and how this stream is processed. The second main portion divided from stream 11, which is stream 12, is the larger portion of the nitrogen refrigerant stream 13 and is about 65% of the main flow of refrigerant and is fed to expander 106 and expanded in expander 106. It is to be noted that stream 11 from which stream 12 was derived had been precooled to a temperature of approx −20° C. in heat exchanger 100. Stream 12 is considerably further cooled in expander 106. The resulting cold stream, stream 18, exits from expander 106 at a temperature of approx −104° C. and is combined with stream 17 which is also at approx −104° C. and is used to cool the natural gas feed in exchangers 102,101 and 100 in turn. Stream 19 is responsible for the close approximation of the refrigerant warming curve to the LNG cooling curve in the regions above about −100° C. in accordance with the present invention.

The cold nitrogen refrigerant stream 20 turning into stream 21 by passing through exchanger 101 is also used to precool the low temperature nitrogen stream 13 turning into stream 14 in exchanger 101 and the combined nitrogen stream 10 as it is precooled to −20° C. in exchanger 100. Stream 18 provides the greater amount of cooling of the process of the present invention.

Figure 2:
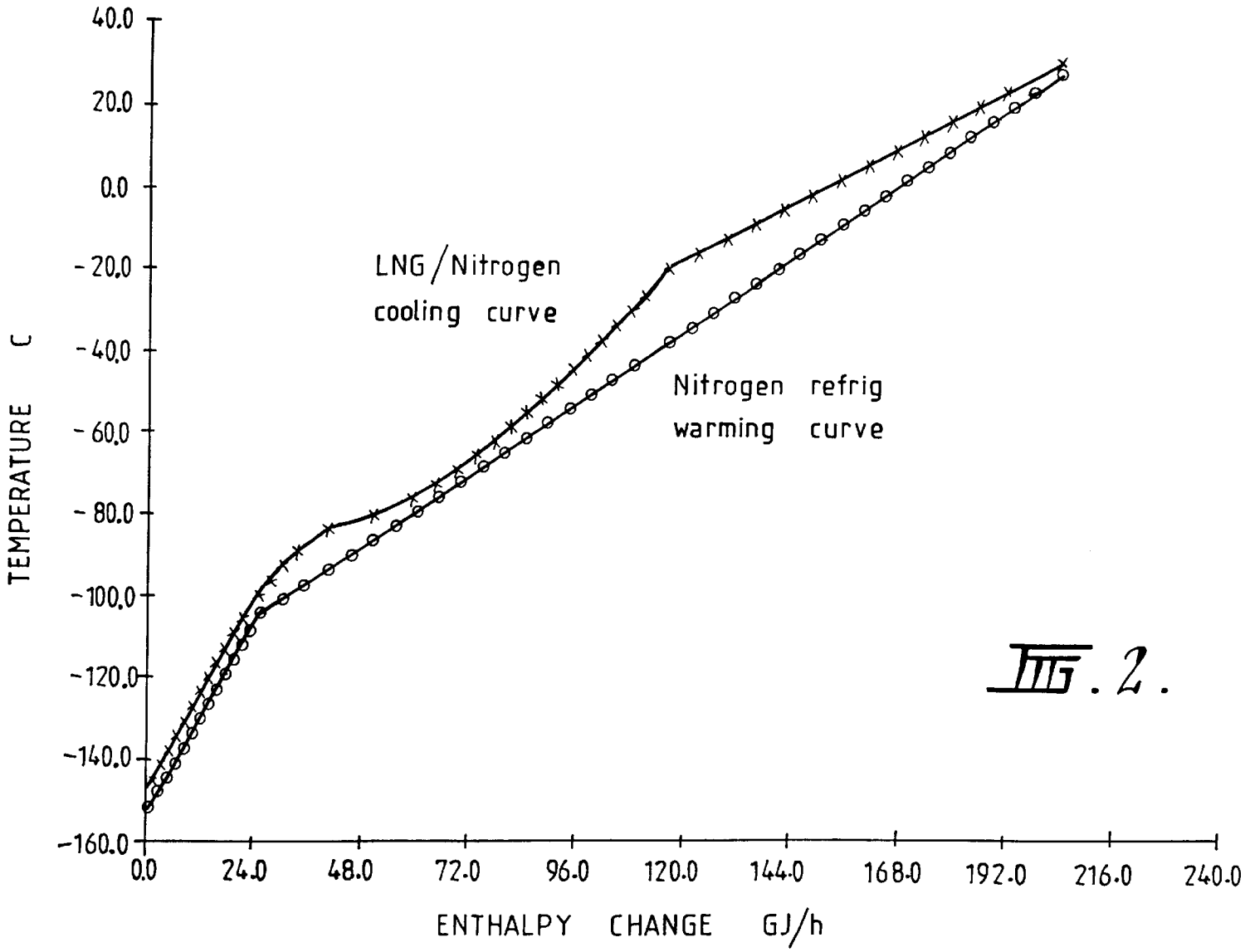
FIG. 2 is a plot similar to FIG. 1 of the nitrogen refrigerant warming curve compared to the LNG/nitrogen cooling curve using the split nitrogen flow expander cycle of the present invention showing a closer matching of the two curves to each other, particularly in the respective intermediate portions, which demonstrates a saving in energy.

With particular reference to FIG. 2 it can be seen that in contrast to the essentially straight line of the refrigerant warming curve of the simple nitrogen cycle as shown in FIG. 1, splitting the nitrogen cycle into two supply portions, streams 12 and 13, at two different temperature levels allows the combined cooling curve of the natural gas and the nitrogen to be matches more closely by the warming curve of the nitrogen refrigerant, especially at the low temperature end of the cooling curve of the nitrogen refrigerant such as at temperatures below −100° C. This is demonstrated by a comparison of FIGS. 1 and 2 which compares the warming curves for the simple nitrogen cycle process with that of the split flow nitrogen cycle process of the present invention. The closer temperature approaches of the split flow nitrogen cycle result in smaller thermodynamic irreversibilities or "exergy losses" and provides a substantial reduction in power requirements for the split flow nitrogen cycle operated in accordance with the present invention.

Thus, it can be readily seen that splitting the nitrogen refrigerant from stream 11 to streams 12 and 13 after passing through exchanger 100 and returning these two streams at a different place in the cycle, by recombining the streams 17 and 18 to form stream 19 prior to exchanger 102, provides the advantages of the present invention.

EXAMPLE 2

Figure 3:
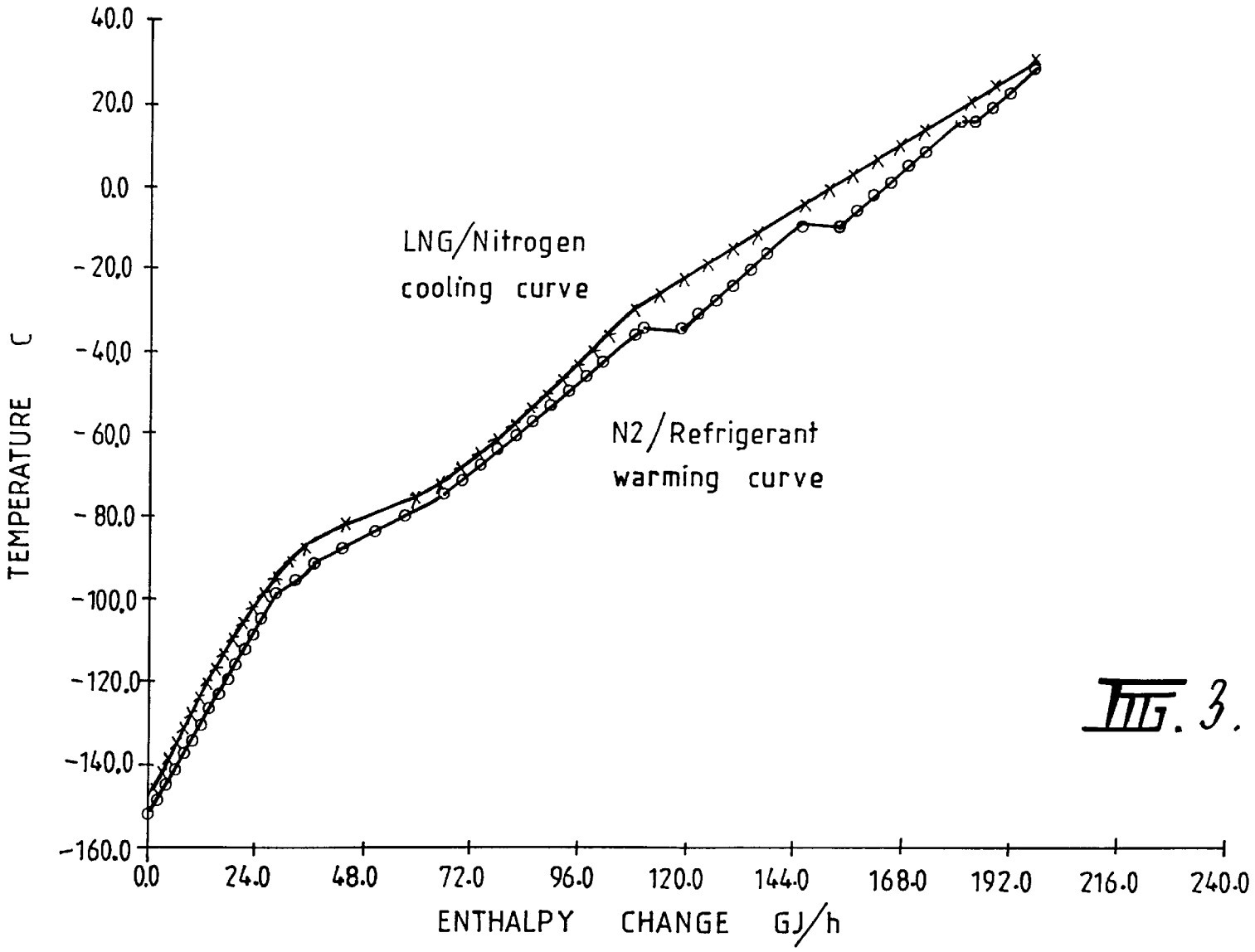
FIG. 3 is a plot of the nitrogen refrigerant warming curve compared to the LNG/nitrogen cooling curve in accordance with the present invention when using further embodiments of the split flow nitrogen expander cycle involving the use of a precooling refrigeration system and serial expanders showing even greater matching of the two curves with respect to each other over almost the entire curves, which results in further energy savings.

A further improvement in power consumption for the split flow nitrogen cycle of the present invention can be obtained by the use of a further embodiment of the present invention which involves the use of a small precooling refrigeration cycle and a third expander to further modify the shape of the nitrogen refrigerant warming curve to match the cooling curve even more closely. FIG. 5 shows an example of the split flow nitrogen expander cycle provided with the modifications of this example mentioned above. The matching of the two curves using this embodiment is shown in FIG. 3. This embodiment will now be described with particular reference to FIGS. 3 and 5. It is to be noted that the reference numerals of FIG. 5 are unique to this embodiment, and may or may not be used to refer to the same features in FIGS. 4 and 6. As in the previous example, lean natural gas 1 is treated and then liquefied by exchange with cold nitrogen gas and flows to storage via a conventional nitrogen rejection unit B if required. Thus, streams 1 through to 8 are as previously described in Example 1, with stream 7 being the LNG which goes to storage and stream 8 being a flash gas derived from nitrogen rejection unit B which is passed to and through exchanger 109 for producing compressed fuel gas. The modification of this embodiment relates to exchanger 100 and the presence of a precool refrigeration system 114 and to having three expanders, 106, 107, 108. The cooled and compressed nitrogen, stream 10, is precooled to a temperature of −30° C. in heat exchanger 100 by exchange against a combination of nitrogen refrigerant stream 21 and a separate refrigeration package 114. This refrigeration package 114 is a conventional refrigeration cycle using propane, freon or ammonia absorption cycles and consumes a relatively small amount of power, such as for example about 4% of total power consumed by the main nitrogen cycle compressors 105. In heat exchanger 100 not only is the feed gas stream 2 being cooled but also nitrogen refrigerant stream 10 is also being cooled. This is the first change from Example 1.

The precooled nitrogen stream 11 emerging from heat exchanger 100 is split into two portions as in Example 1 and the smaller portion, stream 13, is further cooled in heat exchanger 101 and 102 against the counter flow of nitrogen refrigerant in stream 19 and 23 to a temperature of approx −82° C. Stream 15 is then combined with a small stream of nitrogen, stream 36, which has been precooled to approx −120° C. in exchanger device 109 using cold natural gas/nitrogen reject streams, stream 8, produced by the nitrogen rejection unit B where this unit is required. The combined cold stream, stream 16, is then expanded at close to isentropic conditions in expander 108 at a pressure of approx 11 bar. The resulting cold stream, stream 17, at a temperature of approx −152° C. is used to subcool the high pressure LNG in exchanger 104. The flow rate of stream 17 is chosen to give a close approach of the LNG cooling and nitrogen warming curves, in the regions below −100° C.

The larger portion of the nitrogen refrigerant stream, stream 12, is expanded to a pressure of approx 15 bar in expander 106 after precooling to a temperature of approximately −30° C. as described previously in Example 1. The resulting cold stream, stream 22, at a temperature of approx −99° C. is used to cool natural gas feed in exchangers 102,103. This stream is reheated in exchangers 102 and 103 to a temperature of approximately −75° C. and then expanded to a pressure of approx 10.5 bar in expander 107. The resulting cold stream, stream 25, at a temperature of approx −91° C. is combined with stream 18 also at approx −91° C. and is used to cool natural gas feed in exchangers 102,101 and 100. The cold nitrogen is also used to precool the low temp nitrogen stream 13 in exchangers 101 and 102 and nitrogen stream 10 is precooled to −30° C. in exchanger 100 using stream 21 and a conventional refrigeration package unit 114. Thus, stream 12 is in effect divided from the main refrigerant stream, passed sequentially through expanders 106 and 107 before returning to the main refrigerant stream. Therefore, in this embodiment there are two streams in parallel with one of the streams being passed through two expanders in series. This is the second modification of this example.

The warmed nitrogen, stream 37, is recompressed in a multistage compressor unit 105 with intercooling and aftercooling and then boosted in pressure to approx 55 bar by compressors 111, 112 and 113 which are attached to expanders 106, 107 and 108 and recover the majority of the work produced by the expanders. Alternatively, the compressors 111, 112 and 113 may be combined in one compressor driven by expanders 106, 107 and 108 attached to a common shaft. The compressed nitrogen stream 33 is cooled in aftercooler 110 to ambient conditions and flows as stream 10 to exchanger 100 and refrigeration package 114 where it is precooled to −30° C. as described above.

EXAMPLE 3

Figure 5:
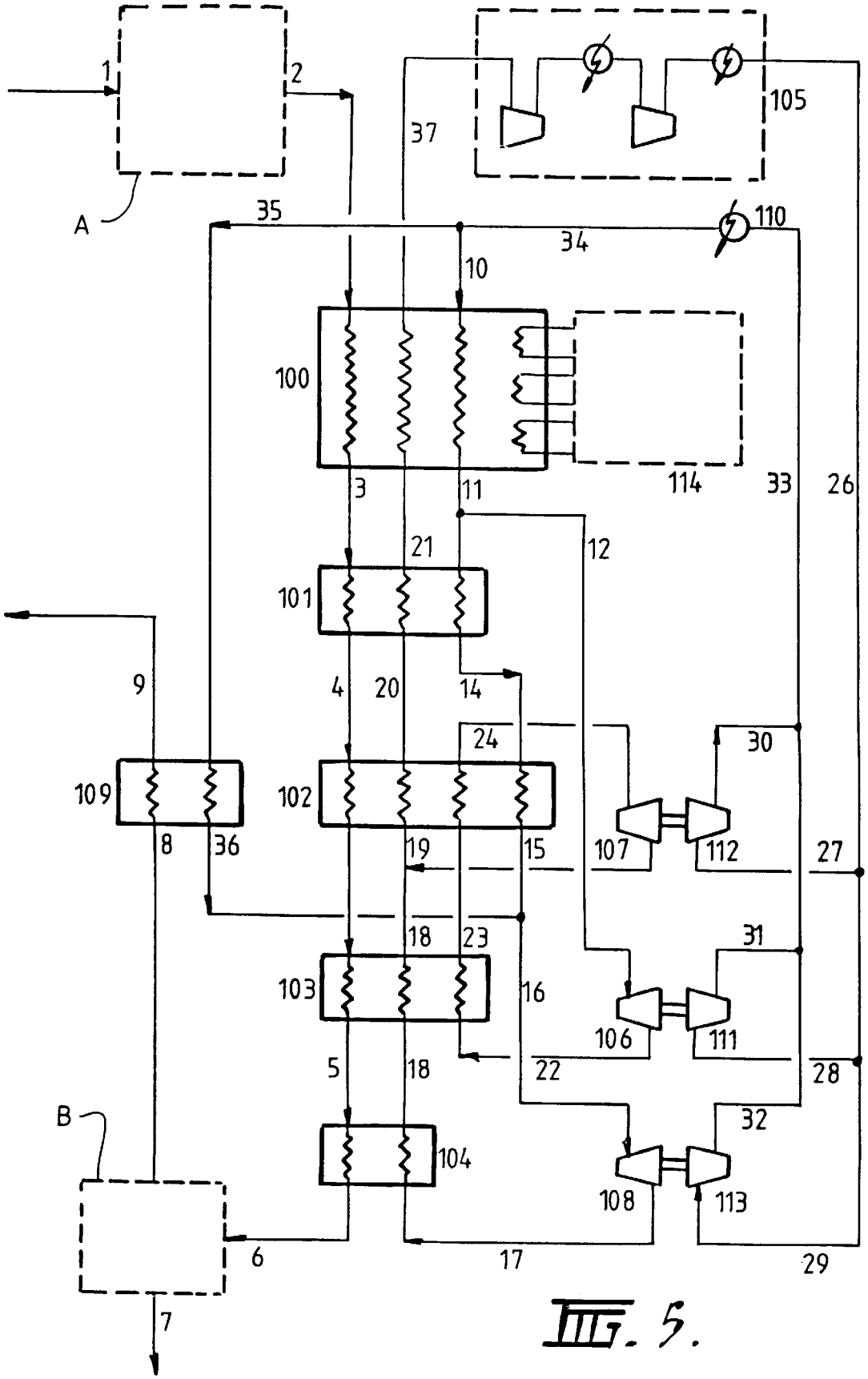
FIG. 5 is a flowchart in accordance with which the split flow nitrogen cycle process of the present invention having a small precooling refrigeration system and reheating expander steps is operated from which the plot of FIG. 3 is derived.
Figure 6:
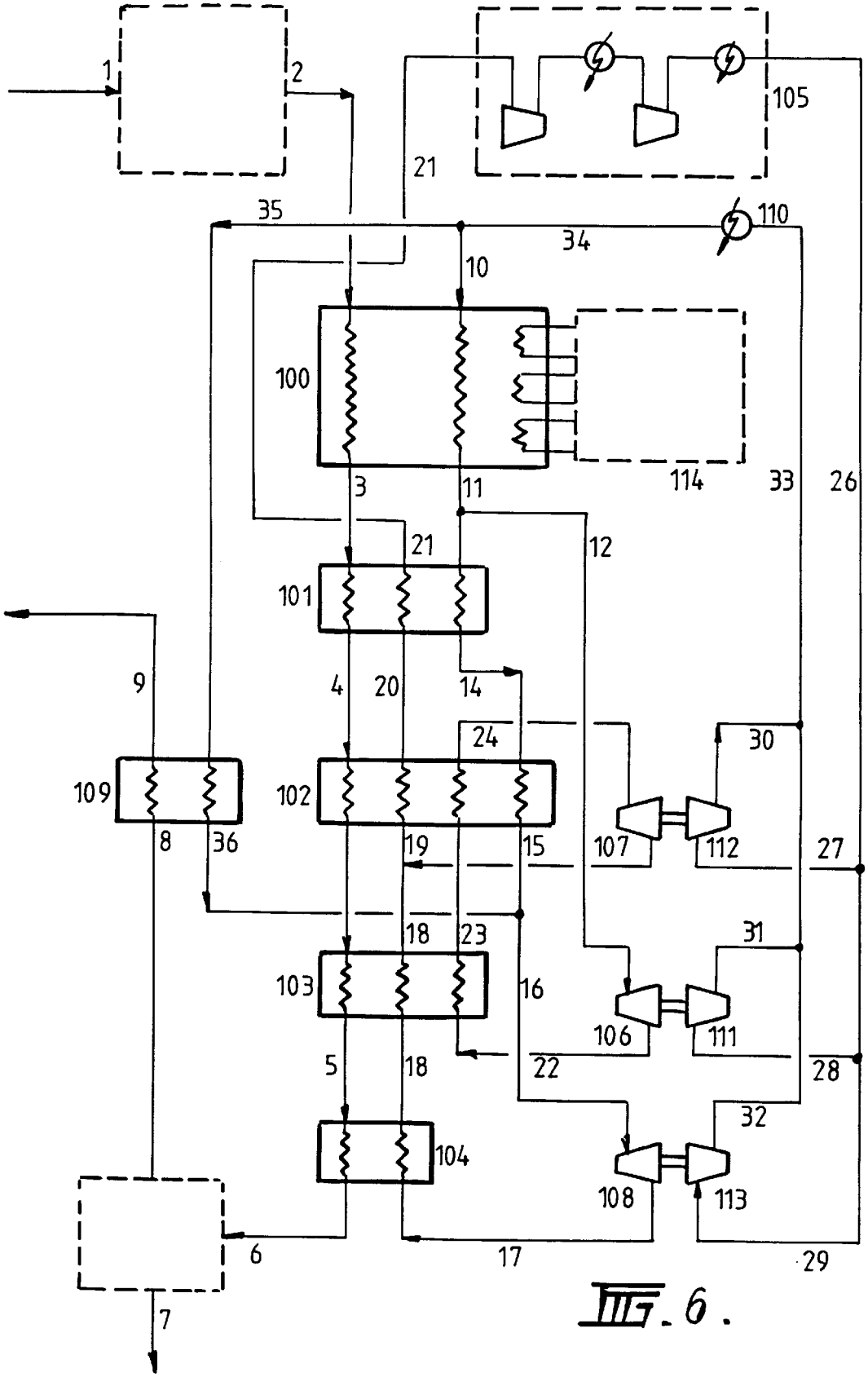
FIG. 6 is a flow chart of the split flow nitrogen cycle process in accordance with the present invention having a full precooling refrigeration system such that one part of the nitrogen refrigerant is not used in the first exchanger and accordingly cold nitrogen is returned to the suction of the compressor.

A modification of the arrangement of FIG. 5 is shown in FIG. 6. The modification of FIG. 6 relates to stream 21 of FIG. 5. Stream 21 of FIG. 5 is passed from exchanger 101 to exchanger 100 from which it emerges as stream 37 which is passed to compressor 105. In the modification of this example as shown in FIG. 6, stream 21 exiting exchanger 101 is not passed through exchanger 100 but rather is connected directly to compressor 105. All the precooling for the high pressure nitrogen stream 10 and natural gas feed stream 2 to −30° C. is now performed by the refrigerant package 114. Thus, stream 21 of FIG. 6 as it enters compressor 105 corresponds to stream 37 of FIG. 5 as it enters compressor 105. However, as stream 21 of FIG. 6 does not pass through exchanger 100 it does not gain heat and accordingly is at a lower temperature than stream 37. Therefore, less work is required to compress and cool the nitrogen refrigerant of stream 21 to form stream 26 in the embodiment of FIG. 6 is required than in the embodiment of FIG. 5 and accordingly the embodiment of FIG. 6 is more energy efficient in operation and requires less power to operate which in turn results in more economical production of LNG. Operation in accordance with this embodiment is otherwise the same as for the embodiment of FIG. 5.

Comparison of alternative cycles

The relative performances of the nitrogen expander cycle as shown in FIG. 1, the embodiments of the split flow nitrogen expander cycle of the present invention as shown in FIG. 2, and the two versions of the split nitrogen expander cycle with precooling and reheat expander as shown in FIG. 3 were simulated for a trial production of 2600 tonnes/day of LNG from a lean natural gas feed at a supply pressure of 55 bar and temperature of 30° C.

For comparison purposes, the flow sheet for the simple nitrogen cycle of the prior art used heat exchangers equivalent to exchangers 100, 101 and 102 only, omitted streams 12,18 and compressor/expander 106,108, i.e. did not have a split nitrogen flow of two parallel streams and did not have two compressors/expanders in parallel which is a characteristic feature of the present invention.

Table 1 compares the power requirements and nitrogen cycle operating conditions of the four alternative nitrogen cycles. For completeness the power requirements are also compared to the Mixed Refrigerant cycle using a figure of 35 MW as being typical of current propane precooled mixed refrigerant processes.

| Cycle | Simple $N_2$ | Split $N_2$ | Split $N_2$ + small precool | Split $N_2$ + full precool | MR cycle |
|---|---|---|---|---|---|
| Cycle Compression Power (MW) | 70.1 | 49.1 | 44.1 | 41.1 | 35.1 |
| % of Simple $N_2$ cycle | 100.0% | 70.0% | 62.9% | 58.6% | 50.0% |
| % of MR cycle | 200.0% | 140.0% | 125.6% | 117.1% | 100.0% |
| $N_2$ circulation rate (tonnes/hr) | 1174 | 1258 | 1013 | 1013 | — |
| $N_2$ compressor suction press (bara) | 5.60 | 9.96 | 9.50 | 9.94 | — |
| $N_2$ compressor discharge press (bara) | 55.0 | 55.0 | 55.0 | 55.0 | — |

From the above results it can be seen that the use of the split nitrogen expander cycle results in a power reduction of 21.1 MW against the simple nitrogen expander cycle with the addition of one expander to the cycle. At a discharge pressure of 55 bara for the nitrogen compression system the optimum expansion ratio for the expander in the simple cycle results in a compressor suction pressure of approximately 5.6 bara to obtain the minimum power consumption. Another effect of the split nitrogen expander cycle is to increase the optimum pressure for that cycle to approx 10 bara. This can be expected to have several benefits including lower circulating refrigerant volumes and hence piping diameter, higher single phase heat transfer coefficients and expansion ratios for the nitrogen expanders that can be achieved with a single expander stage. The higher expansion ratio for the simple nitrogen cycle may require the expansion to be achieved in two expander stages which further adds to the cost.

The modifications to the split nitrogen expander cycle shown in FIG. 5 relating to the use of a third expander result in a further power reduction of 6.8 MW for the nitrogen cycle compressors due to the addition of the third expander and the small precool refrigeration cycle requiring approx 1.8 MW of power giving a net reduction of 5 MW.

If a larger precooling refrigeration cycle is used as shown in FIG. 6 such that all the cooling duty for the natural gas and nitrogen from ambient to −30° C. is performed by a separate refrigeration system, even further power reductions occur. In this case the suction of the nitrogen compressor operates at approximately −36° C. The duty for the precooling refrigeration system increases to 8 MW, however the duty of the nitrogen compressor falls to 33.1 MW giving a further reduction of 3 MW overall.

Figure 4:
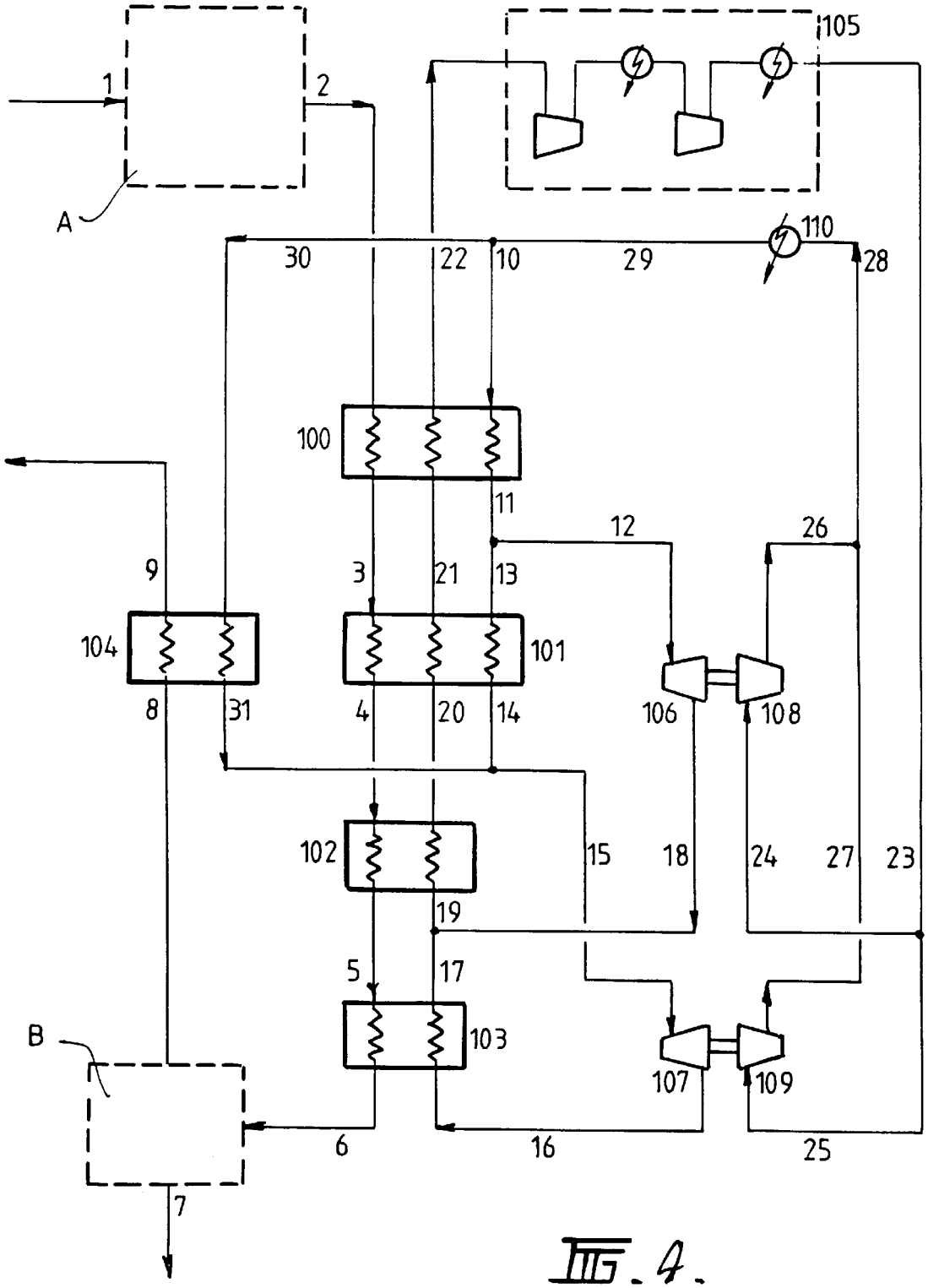
FIG. 4 is a flowchart of the split flow nitrogen expander cycle process operated in accordance with the present invention from which the plot of FIG. 2 is derived.

With particular reference to FIG. 2 and 4 operation of the process of the present invention will now be described. In heat exchanger 100 natural gas feed 2 is precooled to a temperature of about −20° C. At the same time, cool nitrogen stream 10 is further cooled in heat exchanger 100 to about −20° C. Both of the natural gas feed 2 and nitrogen stream 10 are cooled by the action of nitrogen stream 21. The cooling curve of the combined natural gas feed and nitrogen stream 10 is shown in FIG. 2 together with the warming curve of the nitrogen refrigeration stream 21. At the warmest end of exchanger 100 it can be readily seen that both the nitrogen warming curve and the LNG/nitrogen cooling curve are about coincident whereas when the LNG/nitrogen is at about −20° C. the nitrogen refrigerant is at about −38° C.

Heat exchanger 101 reduces the temperature of the natural gas feed stream 3 which exits as stream 4 and the nitrogen refrigerant stream 13 which exits as stream 14 from about −20° C. to about −84° C. by the action of nitrogen refrigerant stream 20.

In heat exchanger 102 the LNG gas stream 4 is reduced from a temperature of about −84° C. to about −100° C. by the action of refrigerant stream 19.

The slope of the nitrogen refrigerant warming curve from about 30° C. to about −105° C. is of constant gradient due to the same amount of refrigerant being passed through each of heat exchangers 102, 101 and 100 in turn.

In heat exchanger 103 the temperature of the natural gas feed stream 5 is reduced from about −100° C. to about −149° C. by nitrogen refrigerant stream 16. As the mass flow rate of nitrogen refrigerant stream 16 is less than that of streams 19, 20 and 21 the slope of the nitrogen refrigeration warming curve over this temperature range is different to that of streams 19, 20 and 21. In the described example the gradient of the nitrogen refrigerant warming curve in exchanger 103 is greater than that in exchangers 102, 101 and 100 and is more closely aligned to the gradient of the LNG cooling curve from about −105° C. to −152° C. Therefore, by judiciously adjusting the circulation rate of nitrogen refrigerant stream 17 coming from expander 107 and passing through heat exchanger 103 it is possible to minimise the energy losses of the split flow nitrogen cycle at the lower end of the temperature range by more closely aligning the warming curve of the nitrogen refrigerant to that of the LNG cooling curve in the same temperature range. Accordingly, less energy is required to operate the overall process and in particular in compressors 105 because less energy is being wasted in exchanger 103, 102 and 101 when compared to the simple nitrogen expander cycle shown in FIG. 1 and more energy is recovered in the isentropic expansion of stream 15 in expander 106 and expander 107 is operated at a higher inlet temperature producing more work than in the simple cycle.

Thus, by having a split flow of the nitrogen refrigerant it is possible to have two expanders in parallel and the relative ratio of the flow in each of the splits of the flow can be selectively adjusted by passing more or less through each expander. With reference to FIG. 2, it can be seen that the same amount of refrigerant passes through exchangers 100, 101 and 102 and hence the slope of the warming curve of FIG. 2 between −105° C. and 30° C. is constant. Because of the split in flow less refrigerant is passed through exchanger 103 than through the remaining exchangers and hence the gradient of the nitrogen refrigerant warming curve corresponding to passage through exchanger 103 to change the temperature from −105° C. to −152° C. is different.

With particular reference to FIG. 3, the effect of having a third expander can be readily seen by the changes to the gradient of the warming curve in the region from about −100° C. to about −80° C. where a closer fit to the cooling curve of the LNG/nitrogen is possible by selectively adjusting the relative ratios of the flows through the expanders.

Also with particular reference to FIG. 3, the effect of the precool refrigeration system 114 can be seen by the change in gradient of the warming curve. In the region above about −40° C. the slope of the warming curve due to the passage of stream 21 through exchanger 100 by itself would result in a temperature cross in exchanger 100 indicating that stream 21 by itself cannot provide sufficient cooling to cool streams 2 and 10 to −30° C. The multistage precooling refrigeration system provides the extra cooling required (indicated by the horizontal portions of the warming curve) at typically 3 temperature levels to maintain the separation of warming and cooling curves.

Advantages of the present invention include that split nitrogen expander cycle operates entirely in the single phase gas region which allows the elimination of all compressor suction drums, phase separators and refrigerant accumulators required in the mixed refrigerant process. The single phase of the refrigerant eliminates the flow distribution problems associated with two phase flow in heat exchanger devices and allows the use of conventional aluminium plate fin exchangers without the associated phase separators and distribution systems normally required or offers an alternative to the highly specialised and expensive spiral wound heat exchangers conventionally used in mixed refrigerant process plants.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

I claim:

1. A natural gas liquefaction process, characterized in that the process comprises the steps of passing natural gas through a series of heat exchangers in countercurrent relationship with a single phase refrigerant gas circulated through a cooling cycle, substantially isentropically expanding portions of refrigerant to different cooling temperatures at which said refrigerant portions are supplied to respective heat exchangers for cooling the natural gas through corresponding temperature ranges, whereby the warming curve for the refrigerant comprising all said portions has sections of different gradients, discharging cooled natural gas from a final heat exchanger at an exit temperature in the range −160° C. to −140° C., and supplying to the final heat exchanger of said series a refrigerant portion at a cooling temperature and in an amount selected in the range of 20 to 50% of the circulated refrigerant so that the part of the refrigerant warming curve relating to the final heat exchanger is closely matched to and has substantially the same slope as the part of the natural gas cooling curve extending over the temperature range from said exit temperature to −100° C.

2. A process according to claim 1, characterized in that the refrigerant is substantially nitrogen.

3. A process according to claim 1, characterized in that the refrigerant portion is supplied to the final heat exchanger is substantially isentropically expanded to a temperature of about −152° C.

4. A process according to claim 2, characterized in that the refrigerant portion is supplied to the final heat exchanger is substantially isentropically expanded to a temperature of about −152° C.

5. A process according to claim 1 characterized in that the refrigerant exits the final heat exchanger at a temperature of about −104° C.

6. A process according to claim 2 characterized in that the refrigerant exits the final heat exchanger at a temperature of about −104° C.

7. A process according to claim 1, characterized in that the refrigerant portion supplied to the final heat exchanger is cooled, before being expanded, by heat exchange with the isentropically expanded refrigerant, the refrigerant portion supplied to and having flowed through the final heat exchanger being combined with another refrigerant portion to form a combined cooling stream, said other refrigerant portion being expanded substantially isentropically to the approximate temperature of the refrigerant with which it is combined, the natural gas and the cooled refrigerant portion being cooled through a temperature range including the range of −80° C. to −40° C., especially −80° C. to −60° C., by the combined cooling stream in a part of said series of heat exchangers upstream of said final heat exchanger, wherein the amount of said other refrigerant portion is so selected in the range of 50 to 80% of the circulated refrigerant that the refrigerant warming curve is closely matched with the combined cooling curve of the natural gas and refrigerant over said temperature range of −80° C. to −40° C., especially −80° C. to −60° C.

8. A process according to claim 2, characterized in that the refrigerant portion supplied to the final heat exchanger is cooled, before being expanded, by heat exchange with the isentropically expanded refrigerant, the refrigerant portion supplied to and having flowed through the final heat exchanger being combined with another refrigerant portion to form a combined cooling stream, said other refrigerant portion being expanded substantially isentropically to the approximate temperature of the refrigerant with which it is combined, the natural gas and the cooled refrigerant portion being cooled through a temperature range including the range of −80° C. to −40° C., especially −80° C. to −60° C., by the combined cooling stream in part of said series of heat exchangers upstream of said final heat exchanger, wherein the amount of said other refrigerant portion is so selected in the range of 50 to 80% of the circulated refrigerant that the refrigerant warming curve is closely matched with the combined cooling curve of the natural gas and refrigerant over said temperature range of −80° C. to −40° C., especially −80° C. to −60° C.

9. A process according to claim 1, characterized in that the refrigerant portions are expanded in respective turbo expanders and are recombined before one portion is admitted to a heat exchanger.

10. A process according to claim 2, characterized in that the refrigerant portions are expanded in respective turbo expander and are recombined before one portion is admitted to a heat exchanger.

11. A process according to claim 1, characterized in that one refrigerant portion is passed through one heat exchanger and then passed to another heat exchanger, and another refrigerant portion is passed through said other heat exchanger and is subsequently recombined with said one portion to form a common refrigerant stream.

12. A process according to claim 2, characterized in that one refrigerant portion is passed through one heat exchanger and then passed to another heat exchanger, and another refrigerant portion is passed through said other heat exchanger and is subsequently recombined with said one portion to form a common refrigerant stream.

13. A process according to claim 1, characterized in that the refrigerant is divided into two portions, and the refrigerant portion supplied to the final heat exchanger is about 35% of the total flow of refrigerant.

14. A process according to claim 2, characterized in that the refrigerant is divided into two portions, and the refrigerant portion supplied to the final heat exchanger is about 35% of the total flow of refrigerant.

15. A process according to claim 1, characterized in that the refrigerant is divided into two portions, the first portion is passed through a single turbo expander and the second portion is passed through two turbo expanders in series, said first and second portions being in parallel and then being recombined before passing through a further one of said heat exchangers.

16. A process according to claim 2, characterized in that the refrigerant is divided into two portions, the first portion is passed through a single turbo expander and the second portion is passed through two turbo expanders in series, said first and second portions being in parallel and then being recombined before passing through a further one of said heat exchangers.

17. A process according to claim 1, characterized in that the refrigerant portions are substantially isentropically expanded for a pressure of about 55 bar.

18. A process according to claim 2, characterized in that the refrigerant portions are substantially isentropically expanded for a pressure of about 55 bar.

19. A process according to claim 1, characterized in that the refrigerant portions are substantially isentropically expanded to a pressure of about 11 bar.

20. A process according to claim 2, characterized in that the refrigerant portions are substantially isentropically expanded to a pressure of about 11 bar.

21. A process according to claim 1, characterized in that the refrigerant stream is divided into three portions in a ratio of about 10% to 30% for the first portion, from about 30% to 70% for the second portion and from about 20% to 40% for the third portion, preferably about 20%/50%/30% by volume for the first, second and third portions respectively, and the refrigerant portions are expanded in expanders arranged in parallel relationship with each other.

22. A process according to claim 2, characterized in that the refrigerant stream is divided into three portions in a ratio of about 10% to 30% for the first portion, from about 30% to 70% for the second portion and from about 20% to 40% for the third portion, preferably about 20%/50%/30% by volume for the first, second and third portions respectively, and the refrigerant portions are expanded in expanders arranged in parallel relationship with each other.

23. A process according to claim 21, characterized in that the refrigerant portion supplied to the final heat exchanger is expanded to about 11.7 bar.

24. A process according to claim 22, characterized in that the refrigerant portion supplied to the final heat exchanger is expanded to about 11.7 bar.

25. A process according to claim 1, characterized in that the refrigerant is cooled in a precool refrigeration system before being divided to form said portions.

26. A process according to claim 3, characterized in that the refrigerant is cooled in a precool refrigeration system before being divided to form said portions.

27. A liquid natural gas produced by a process according to claim 1.

28. A liquid natural gas produced by a process according to claim 2.

29. Apparatus for liquefying natural gas by cooling with a single phase refrigerant consisting substantially of nitrogen, comprising a series of heat exchangers, and a compressor having an inlet connected to receive warmed refrigerant from the heat exchanges and an outlet connected to deliver refrigerant to further compressor means driven by turbo expanders through which portions of compressed refrigerant are isentropically expanded and cooled to different temperatures for use with different heat exchangers, said turbo expanders having refrigerant outlets connected to respective heat exchangers for delivering the different cooled portions of the refrigerant to respective heat exchangers for passage therethrough in countercurrent relationship with the natural gas, wherein the warming curve for the refrigerant comprises sections having different gradients and a part of the refrigerant warming curve relating to passage through a final heat exchanger is closely matched to and has substantially the same gradient as a part of the natural gas cooling curve extending over the same temperature range of the final heat exchanger.

* * * * *